United States Patent [19]

Roetzel

[11] Patent Number: 4,798,146

[45] Date of Patent: Jan. 17, 1989

[54] SUSPENSION MEANS FOR A RUNNING RAIL OF A SUSPENSION RAILWAY

[75] Inventor: Hartmut Roetzel, Rameldange, Luxembourg

[73] Assignee: Cleveland Tramrail International S.A., Clervaux, Luxembourg

[21] Appl. No.: 868,730

[22] Filed: May 30, 1986

[30] Foreign Application Priority Data

May 31, 1985 [LU] Luxembourg ..... 85923

[51] Int. Cl.[4] ..... E01B 25/24

[52] U.S. Cl. ..... 104/111; 104/93; 104/109; 191/40

[58] Field of Search ..... 104/89, 93, 106, 110, 104/111, 107, 109, 125; 105/150; 191/33 R, 40, 42, 43

[56] References Cited

U.S. PATENT DOCUMENTS 1,103,310 7/1914 Olson ..... 104/111 X
4,393,785 7/1983 Hortnagel ..... 104/111 X
4,545,303 10/1985 Fujita et al. ..... 104/110 X
4,646,647 3/1987 Spöler et al. ..... 104/111

FOREIGN PATENT DOCUMENTS 3338840 5/1985 Fed. Rep. of Germany ..... 104/111

*Primary Examiner*—Robert B. Reeves
*Assistant Examiner*—Scott H. Werny
*Attorney, Agent, or Firm*—Charles E. Brown; Charles A. Brown

[57] ABSTRACT

A running rail has a double T profile formed by two chords connected with a web. Grooves extend parallel to the web, in the inner sides of both chords. On a lower end, the suspension arm has a suspension plate with an upper edge that engages into the groove in the upper chord. A securing claw is provided that engages the lower groove with one end, and engages the side of the suspension plate remote from the web, with the other end. At the upper end of the suspension arm is a roof flange which is horizontally adjustably connected by using a nut and bolt cooperating with a bush.

19 Claims, 2 Drawing Sheets

SUSPENSION MEANS FOR A RUNNING RAIL OF A SUSPENSION RAILWAY

BACKGROUND OF THE INVENTION

1. Field of the Invention

The invention relates to a suspension means for a running rail of a suspension railway comprising a running rail which is formed as double T profile with horizontal chords and a vertical web connecting the chords, grooves extending parallel to the web in the facing inner sides of the chords and a suspension arm having at the lower free end a suspension plate, and means for pressing the suspension plate onto the running rail.

2. Background Information

Suspension means for running rails of suspension or telpher railways are known inter alia from European patent No. 0040292, partially corresponding to German patent No. 3,019,301 and European patent application No. 0092608 and the identical German specification as laid open to inspection No. 3,214,437.

These known suspension means consist of rearwardly engaging clamping elements which cooperate with flanges which are formed on the chord and face each other. Furthermore, German specification as laid open to inspection No. 3,302,262 discloses as support face for a support plate secured to a support or beam a shoulder formed at the transition from the web to the chord. The actual securing of the running rail to the support plate is by a pressure plate which bears in grooves formed on the chord and presses by means of threaded bolts the support plate in full surface engagement against the web.

SUMMARY OF THE INVENTION

The problem underlying the invention is to provide a suspension means for running rails of suspension railways which both from the constructional point of view and from the point of view of the assembly requirements represents a considerable improvement and simplification compared with the prior art.

From the constructional point of view it is achieved with the present invention that the bending moments which can occur in the chords due to the suspension are minimized. At the same time the arrangement according to the invention permits simple assembly: the rail is hooked in and then, prior to attaching the securing means, can be displaced and aligned without any danger of dropping out.

A further advantage resides in that the running rail can readily be suspended laterally inverted or inverted; this can be useful when the upper running face is worn or when aligning the running rail.

For suspension of the suspension arm on the roof structure an adjustable system is provided which compensates constructional tolerances.

DESCRIPTION OF THE DRAWINGS

Examples of embodiment of the subject of the invention are illustrated in the drawings, wherein.

DESCRIPTION OF THE PREFERRED EMBODIMENT

Figure 1:
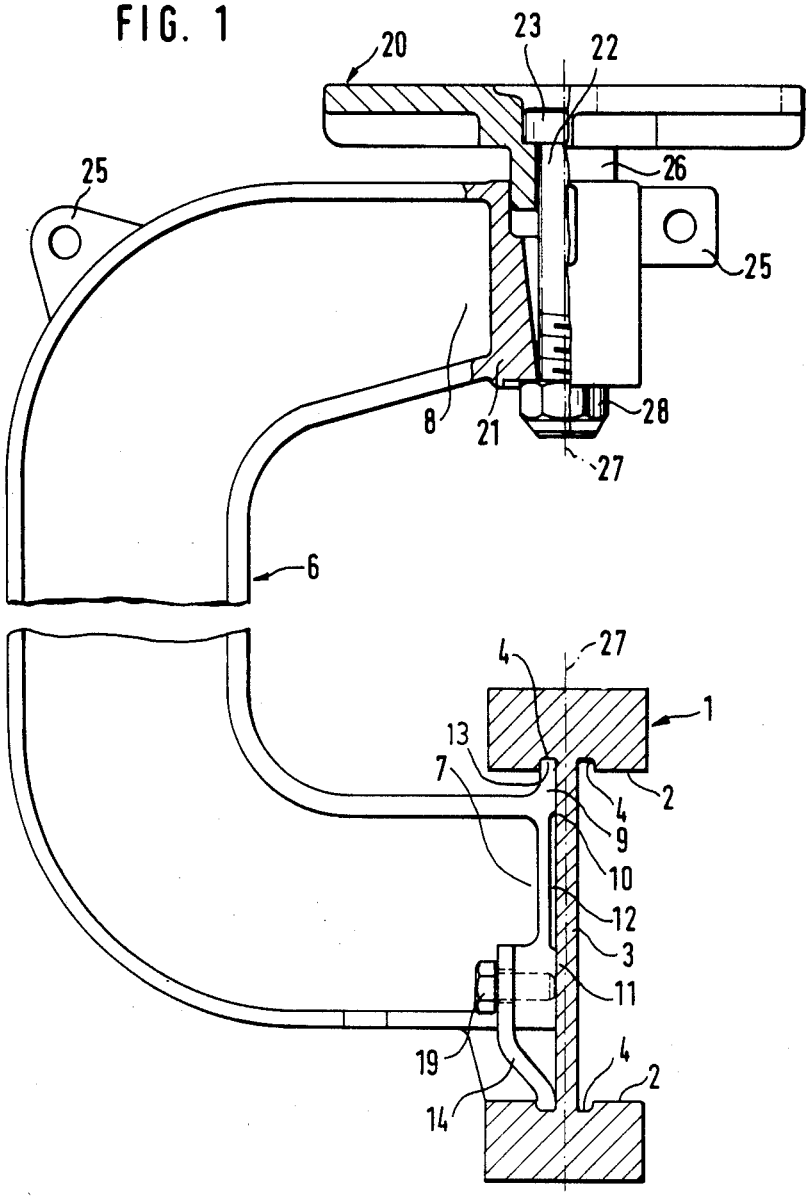
FIG. 1 shows a suspension means for a running rail with suspension arm and roof securing means according to the invention.
Figure 2:
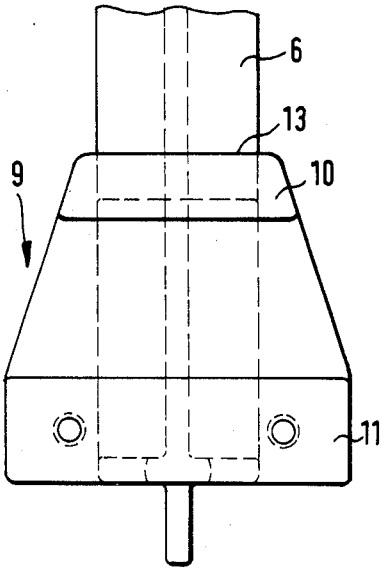
FIG. 2 shows the suspension means before tightening of the securing means.
Figure 2:
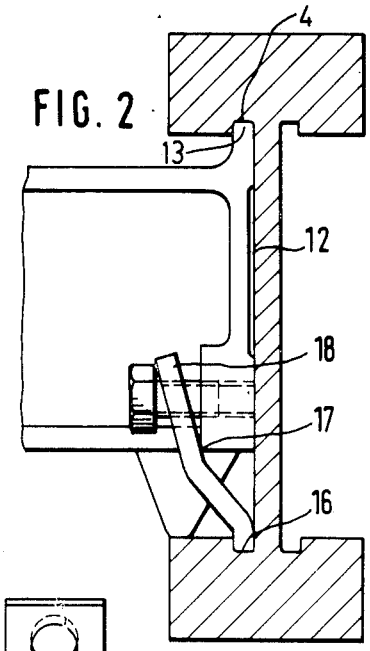

The suspension means for a running rail 1 with horizontal flanges or chords 2 and vertical web 3 illustrated in FIGS. 1 and 2 consists essentially of a suspension arm 6 which at its lower free end 7 comprises a suspension plate 9 which engages with its upper edge 13 into a groove 4 formed on the chord. The upper edge thus serves as support face for the running rail by the engagement into the groove extending parallel to the web dropping out during assembly and before the securing means have been attached is impossible. At the same time, however, longitudinal displacement is possible without applying excessive force.

At the lower region 11 of the suspension plate 9 the securing means 19 are attached. They cooperate with at least one securing claw 14 which with its lower edge 16 engages in a groove 4 formed on the lower chord and in its upper region 18 is pressed by the tightening of the securing means against the suspension plate.

Figure 3:
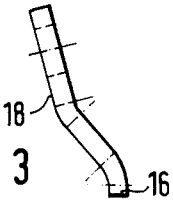
FIG. 3 shows a side elevation of the securing claw according to the invention.
Figure 4:
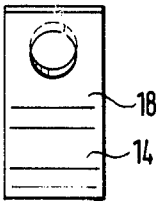
FIG. 4 shows a front elevation of the securing claw of FIG. 3.

The securing claw according to FIGS. 3 and 4 is preferably bent in its upper region with respect to the perpendicular suspension plate. As apparent from FIG. 2 by the tightening of the securing means 19 a two-arm leverage arises, the center region 17 of the securing claw acting as tilt axis and thus pressing the suspension plate firmly against the web. The bent upper region of the securing claw can either be made resilient or can permanently deform.

To compensate for production irregularities at the side of the securing plate facing the web and thus avoid point stresses at the web the center region of the securing plate 9 is provided with a recess 12. Thus, the only perpendicular pressure area is the upper region 10 and the lower region 11.

The suspension arm according to FIGS. 1 and 2 is preferably made C shaped and the upper free end serves to secure the suspension means to the roof structure. For this purpose at the upper free end 8 a bush 21 is formed which cooperates with a bolt 22. Said bolt is suspended at its head end 23 in a roof flange 20 which is in turn secured to the roof structure (not shown). A hub-shaped projection 22 engages for centering into the upper portion of the bush 21. A horizontal adjustment is achieved by adjusting a setting nut 28 which is disposed at the lower end of the bolt.

Figure 5:
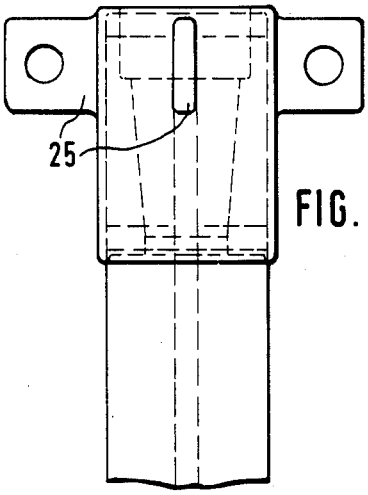
FIG. 5 is a front elevation of the suspension arm according to the invention.
Figure 6:
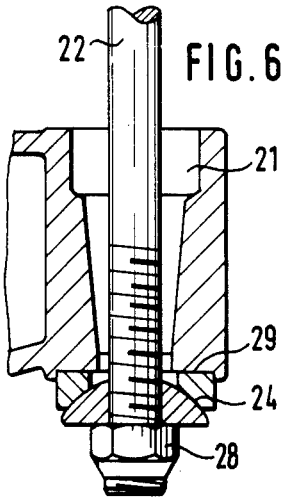
FIG. 6 shows a further example of embodiment of the roof securing according to the invention.

FIG. 6 shows another embodiment of the suspension bolt 22. To bridge greater constructional distances between the roof structure (not shown) and the upper portion of the suspension arm the bolt suspended according to FIG. 5 at its head end in the roof flange is constructed as tie rod or draw bar. At the lower end a pivot bearing 24 is provided which bears against the setting nut 28 and on which a shoulder formed in the bush 21 rests.

On the suspension arm according to FIGS. 1 and 5 for transverse stabilizing eyes 25 are provided into which correspondingly suitable means engage (not shown).

The C-shaped suspension arm 6 with the suspension plate 9 disposed at its lower free end and with the bush 21 disposed at its upper free end can be made both in welded form and as casting. The running rail according to FIGS. 1 and 2 may consist of rolled or welded material. However, in a preferred embodiment it is an extruded profile of aluminium. The grooves 4 disposed in the chords 2 are preferably arranged on either side of the web, directly at the transition from the web to the chord. The running rail thus has a profile which is completely symmetrical both to the horizontal and to the vertical axis and can therefore be arranged laterally inverted or inverted.

The side of the running rail opposite the suspension with its groove is employed to secure an electric slide rail (not shown) for controlling the suspension railway.

To avoid any unnecessary bending moments occurring at the suspension arm with its roof securing and its suspension means the vertical axes 27 of the running rail and of the roof bolt lie on a plane.

I claim:

1. Suspension means for a running rail of a suspension railway comprising a running rail which is formed as double T profile with horizontal chords and a vertical web connecting the chords, grooves extending parallel to the web in the facing inner sides of the chords and a suspension arm having at the lower free end a suspension plate, and means for pressing the suspension plate onto the running rail, characterized in that the suspension plate engages with its upper edge into the groove of the upper chord and that at least one securing claw is provided which is offset with respect to the vertical axis of the suspension plate and which engages with its lower edge into the groove of the lower chord and which by at least one securing means is firmly pressed together with the side of the suspension plate remote from the web.

2. Means according to claim 1, characterized in that the grooves are disposed on either side of the web in the facing inner sides of the chords.

3. Means according to claim 1, characterized in that the grooves are formed directly at the transition from the web to the chord.

4. Means according to claim 1, characterized in that the running rail is formed perfectly symmetrically with respect to the vertical and horizontal axes.

5. Means according to claim 1, characterized in that the securing claws engaging with their lower edge into the lower groove are tiltably disposed in their center region against the lower edge of the suspension plate remote from the web and that the upper region of the securing claws is bent at least prior to the attachment of the securing means with respect to the side of the suspension plate facing it in such a manner that on tightening of the securing means two-arm leverage arises which presses the suspension plate in the direction of the web.

6. Means according to claim 1, characterized in that the securing claws are bent in their upper region and that by the tightening of the securing means, are permanently deformed.

7. Means according to claim 1, characterized in that the securing claws are resiliently bent.

8. Means according to claim 1, characterized in that the securing means are formed as screws which engage in the lower region of the suspension plate on the side remote from the web and that the securing claws are provided in their upper region with bores through which the screws are led.

9. Suspension means for a running rail of a suspension railway comprising a suspension arm at the lower free end of which a suspension plate in particular according to claim 1 is provided and a means for pressing the suspension plate against the running rail, characterized in that the suspension arm comprises at its upper free end a bush which cooperates in vertically adjustable manner with a bolt.

10. Suspension means according to claim 9, characterized in that the suspension arm is made C shaped and the perpendicular axis of the bush lies substantially on the same axis which extends perpendicularly through the web of the running rail.

11. Suspension means according to claim 9, characterized in that the vertically adjustable bolt is suspended at its head end in a roof flange.

12. Suspension means according to claim 11, characterized in that the roof flange comprises a hub-shaped perpendicularly downwardly pointing projection which engages in the bush formed at the upper free end of the suspension arm.

13. Suspension means according to claim 9, characterized in that the bush is mounted pivotally in all directions at its lower end cooperating with the bolt.

14. Suspension means according to claim 9, characterized in that on the suspension arm at least one eye is provided into which a stabilizing structure can engage.

15. Suspension means according to claim 1, characterized in that the suspension arm with the suspension plate formed at its lower free end and with the bush formed at its upper free end consists of one casting.

16. Means according to claim 5, characterized in that the securing claws are bent in their upper region and that by the tightening of the securing means are permanently deformed.

17. Means according to claim 5, characterized in that the securing claws are resiliently bent.

18. Suspension means according to claim 9, characterized in that the C-shaped suspension arm with the suspension plate formed at its lower free end and with the bush formed at its upper free end consists of one casting.

19. Suspension means for a running rail of a suspension railway comprising a suspension arm at the lower free end of which a suspension plate in particular according to claim 1 is provided and a means for pressing the suspension plate against the running rail, characterized in that the suspension arm comprises at its upper free end a bush which cooperates in a vertically adjustable manner with a bolt, the suspension arm is made C-shaped and the perpendicular axis of the bush lies substantially on the same axis which extends perpendicularly through the web of the running rail, the vertically adjustable bolt is suspended at its head end in a roof flange, and the bush is mounted pivotally in all directions at its lower end cooperating with the bolt.

* * * * *